US006994816B2

(12) United States Patent
Ishii et al.

(10) Patent No.: US 6,994,816 B2
(45) Date of Patent: Feb. 7, 2006

(54) EQUIPMENT AND METHOD FOR MANUFACTURING HONEYCOMB STRUCTURAL BODY

(75) Inventors: Takeyuki Ishii, Nagoya (JP); Yuji Asai, Chita (JP); Eiji Ito, Yokkaichi (JP)

(73) Assignee: NGK Insulators, Ltd., Nagoya (JP)

( * ) Notice: Subject to any disclaimer, the term of this patent is extended or adjusted under 35 U.S.C. 154(b) by 11 days.

(21) Appl. No.: 10/486,892

(22) PCT Filed: Apr. 11, 2003

(86) PCT No.: PCT/JP03/04624

§ 371 (c)(1),
(2), (4) Date: Feb. 17, 2004

(87) PCT Pub. No.: WO03/089209

PCT Pub. Date: Oct. 30, 2003

(65) Prior Publication Data

US 2004/0195719 A1 Oct. 7, 2004

(30) Foreign Application Priority Data

Apr. 19, 2002 (JP) ..... 2002-117383

(51) Int. Cl.
*B28B 3/20* (2006.01)
*B28B 11/16* (2006.01)

(52) U.S. Cl. ..... 264/150; 83/862; 83/79; 264/630; 425/315; 425/135; 425/169

(58) Field of Classification Search ..... 425/113, 425/315, 135, 169; 83/862, 79; 264/630, 264/150

See application file for complete search history.

(56) References Cited

U.S. PATENT DOCUMENTS

| | | | | | |
|---|---|---|---|---|---|
| 4,702,138 | A | * | 10/1987 | Hattori et al. | 83/785 |
| 4,935,179 | A | * | 6/1990 | Kato et al. | 264/40.1 |
| 6,063,323 | A | * | 5/2000 | Fuls et al. | 264/432 |
| 6,520,061 | B2 | * | 2/2003 | Fukuta et al. | 83/651.1 |
| 6,711,979 | B1 | * | 3/2004 | Miyakawa et al. | 83/862 |
| 6,742,424 | B2 | * | 6/2004 | Fukuta et al. | 83/13 |
| 6,814,562 | B2 | * | 11/2004 | Shibagaki et al. | 425/382 R |

FOREIGN PATENT DOCUMENTS

| | | | |
|---|---|---|---|
| JP | A 63-230304 | | 9/1988 |
| JP | B2 64-6916 | | 2/1989 |
| JP | A 2001-47419 | * | 2/2001 |
| JP | A 2001-96524 | | 4/2001 |
| WO | WO 01/07224 A1 | | 2/2001 |

* cited by examiner

*Primary Examiner*—Robert Davis
*Assistant Examiner*—G. Nagesh Rao
(74) *Attorney, Agent, or Firm*—Oliff & Berridge, PLC

(57) ABSTRACT

An apparatus for producing a honeycomb structure having an extruder, at least one cradle and a cutting device comprising a small-gage wire for cutting the honeycomb structure and a notching member; said cradle is provided with a means capable of moving the honeycomb structure extruded from the extruder in the lengthwise direction of the honeycomb structure at nearly the same speed as the extrusion speed of the honeycomb structure, said cutting device is constructed so that the cutting small-gage wire is moved to the honeycomb structure side on the same plane as the plane of stretched small-gage wire, a cutting induction groove is formed on the outer peripheral side surface of the honeycomb structure by the notching member, and immediately thereafter the cutting small-gage wire is positioned in the induction groove, and the cutting small-gage wire is pressed into the honeycomb structure to cut the honeycomb structure.

20 Claims, 10 Drawing Sheets

EQUIPMENT AND METHOD FOR MANUFACTURING HONEYCOMB STRUCTURAL BODY

TECHNICAL FIELD

The present invention relates to an apparatus for producing a honeycomb structure and a method for producing a honeycomb structure using the apparatus. More particularly, the present invention relates to an apparatus for producing a honeycomb structure which is suitable for continuously molding a thin-wall or large-sized honeycomb structure and a method for producing a honeycomb structure using the apparatus.

BACKGROUND ART

In the recent advocation of environmental protection, demand for ceramic honeycomb structures used as catalyst carriers for purification of exhaust gases and others much increases, and as for apparatuses and method for producing them, those apparatuses are used which have attained high productivity by continuous extrusion of the honeycomb structures.

On the other hand, as to the honeycomb structures, attempts have been earnestly made to reduce the heat capacity of cell walls supporting catalysts by reducing the thickness of the cell walls for rapidly raising the catalyst temperature at the time of starting of engine to improve purification performance, and at present a thickness of the cell walls of 0.1–0.2 mm is mainly employed, and in some cell walls a thicknes of less than 0.1 mm is employed. Furthermore, the attempt to thin the cell walls is also made for large-sized honeycomb structures, and at present, large-sized products of more than 150 mm in outer diameter which are thinned in walls are put to practical use.

Under the circumstances, conventional apparatuses for producing honeycomb structures and method for producing them are generally those according to which honeycomb structures extruded from an extruder are continuously extruded in a direction perpendicular to the gravity direction while placing them on a plurality of cradles having concave faces corresponding to the shape of the outer peripheral side face (JP-B-64-6916).

As an automatic cutting device suitable for the apparatuses for producing honeycomb structures and method for producing them by the continuous extrusion molding, there is disclosed an automatic cutting device having a cradle on which the honeycomb structures are placed, a carrying path for moving the cradle with the honeycomb structures placed thereon, a speed sensor for sensing the extruding speed of the honeycomb structures, a cutting device carrying out the cutting of the honeycomb structures while moving in the moving direction of the honeycomb structures at the same speed as the extruding speed of the honeycomb structures which is sensed by the speed sensor (the same patent publication referred to as above).

Furthermore, as the cutting device for cutting the honeycomb structure, small-gage wires made of steel are generally used, and moreover as a cutting device which does not cause distortion of outer walls and cell walls of the honeycomb structures when the small-gage wires are put into the honeycomb structure, there are disclosed a cutting method and an automatic cutting device in which grooves for inducing cutting are provided by a knife or the like on the outer peripheral side surface of the honeycomb structures which is highest in cutting resistance, and the small-gage wires are put in the grooves to cut the honeycomb structures (JP-A-2001-96524).

However, since according to the conventional apparatues and methods, the honeycomb structure is extruded in the direction perpendicular to the gravity direction, there is a problem that its own weight is apt to be applied in the thickness direction of cell wall which is structually small in strength. Therefore, in case a honeycomb structure which is considerably reduced in strength due to the reduction in wall thickness or a honeycomb structure in which its own weight is apt to be applied in the thickness direction of the cell wall due to increase in size is produced, there occurs distortion of outer wall such as rupture, or distortion of cell wall such as cell twisting or mesh creasing owing to its own weight, and these are severe causes to hinder reduction in thickness of walls and increase in size of the honeycomb structure.

DISCLOSURE OF INVENTION

The present invention has been made in view of the above problems, and the object of the present invention is to provide an apparatus and method for producing a honeycomb structure by which a thin-wall or large-sized honeycomb structure can be continuously produced with causing no distortion of outer shape and cell walls.

As a result of intensive investigations by the inventors in an attempt to solve the above problems, first an extruder is provided so that the extrusion direction is the gravity direction or an oblique direction at an angle of smaller than 30° with the gravity direction so as to apply the own weight of the honeycomb structure mainly in the lengthwise direction of the cell wall which has structurally the highest strength.

However, in the case of the apparatus of such an extrusion direction, when the honeycomb structure extruded extends in length, the own weight generated by gravity cannot be supported by a large area for the physical reason and structural reason of the apparatus, being different from conventional apparatuses in which the area supporting the own weight increases depending on the extension of the length. When as in the conventional automatic cutting devices, formation of grooves by notching and cutting of the honeycomb structure by small-gage wires are independently carried out, there is caused a new problem that distortion is apt to occur in the honeycomb structure.

That is, when the honeycomb structure is extruded in the gravity direction or the like, the honeycomb structure extruded becomes difficult to maintain its inherent attitude even by a very small force in the diameter direction with extension of the length and increase of its own weight. Therefore, in case the above two steps are carried out independently as in the conventional apparatuses, which require a longer time for completion of cutting, there occurs distortion of outer wall due to bend or rupture of the honeycomb structure or distortion of cell walls due to cell twisting at the honeycomb structure positioned at the opening of head to which force in the diameter direction is apt to be concentrated at the time of cutting and furthermore owing to the factors such as vibration of machine.

As a result of further investigations conducted by the inventors, it has been found that by using a cutting device in the apparatus for producing a honeycomb structure which has a frame body, a cutting small-gage wire stretched on the frame body, and a notching member provided with a position to notch the honeycomb structure, an cutting induction groove is formed on the outer peripheral side surface by the notching member, immediately thereafter the cutting small-gage wire is positioned in the groove, and the cutting small-gage wire is inserted as it is into the honeycomb structure to perform cutting, whereby the above problems can be solved. Thus, the present invention has been accomplished.

That is, the present invention provides an apparatus for producing a honeycomb structure having an extruder for continuously extruding a honeycomb structure in the gravity direction or an oblique direction at an angle of smaller than 30 with the gravity direction, at least one cradle on which the honeycomb structure extruded is placed and can be moved, and a movable cutting device, said cutting device comprising a frame body, a cutting small-gage wire stretched on the frame body, and a notching member provided with a position to notch the honeycomb structure on the plane including the stretched cutting small-gage wire, said cradle being provided with a means of placing on the cradle the honeycomb structure extruded from the extruder with its cell opening end face being supported by the cradle and capable of moving the honeycomb structure in this state in lengthwise direction at nearly the same speed as the extrusion speed in the lengthwise direction of the honeycomb structure, said cutting device capable of forming a cutting induction groove on the outer peripheral side surface of the honeycomb structure by the notching member by moving the stretched cutting small-gage wire to the honeycomb structure side on the plane including the cutting small-gage wire while said cutting device is moved in the same direction and at nearly the same speed as the cradle nearly synchronously with the movement of the cradle in the lengthwise direction, immediately after formation of the induction groove, the cutting small-gage wire being positioned in the induction groove and the cutting small-gage wire being inserted as it is into the honeycomb structure to be able to cut the honeycomb structure.

The cutting device in the present invention is preferably such that the frame body is constructed including at least two arm members, a rotating member fitted at the tip of each arm member and a driving part to connect both ends of the cutting small-gage wire, and is provided with a means to move the cutting small-gage wire stretched between the rotating members in the stretching direction by the working of the driving part.

Furthermore, in the present invention, the apparatus is preferably further provided with a speed sensor which senses the extrusion speed of the honeycomb structure in the lengthwise direction in non-contact with the honeycomb structure, and provided with a means to move the cradle or the cradle and the cutting device at nearly the same speed as the extrusion speed of the honeycomb structure in the lengthwise direction.

Furthermore, the apparatus is further preferably provided with a load sensor sensing the load applied to the cradle and provided with a means to start moving of the cradle or the cradle and the cutting device based on the information sensed by the load sensor on the change of load caused at the time of the honeycomb structure being placed on the cradle. Moreover, in the present invention, the apparatus is preferably provided with a means by which the change of load applied to the cradle which is caused due to the deviation between the moving speed of the cradle after starting of the movement and the extrusion speed of the honeycomb structure in the lengthwise direction is sensed by the load sensor, and the cradle or the cradle and the cutting device are moved based on the information sensed by the load sensor.

Further, in the present invention, the apparatus is preferably provided with a means by which the change of the load applied to the cradle which is caused at the time of completion of cutting of the honeycomb structure is sensed by the load sensor and the movement of the cradle on which the cut honeycomb structure is placed is started based on the information sensed by the load sensor.

The present invention further provides a method for producing a honeycomb structure which comprises forming an inducing groove on the outer peripheral side surface of the honeycomb structure by a notching member while continuously extruding the honeycomb structure from an extruder and then cutting the honeycomb structure by inserting a cutting small-gage wire into the inducing groove, characterized in that the honeycomb structure is extruded in the gravity direction or the like and the formation of the inducing groove by the notching member and the insertion of the small-gage wire into the inducing groove are carried out simultaneously.

In the production method of the present invention, it is preferred that the cutting of the honeycomb structure is carried out while moving the small-gage wire for cutting at the same speed as the extrusion speed of the honeycomb structure in the lengthwise direction and in the same direction as the lengthwise direction.

Moreover, in the present invention, it is preferred that the cutting of the honeycomb structure is carried out in the state of the honeycomb structure being placed on the cradle with being accompanied by the movement in the stretching direction of the small-gage wire for cutting.

A course of operation of the apparatus for producing the honeycomb structure of the present invention will be explained in sequence of steps referring to FIGS. 2(*a*)–(*c*), FIGS. 3(*a*)–(*c*), and FIGS. 4. FIG. 2(*a*)–(*c*) show one embodiment of the apparatus for producing a honeycomb structure according to the present invention, and more specifically the apparatus for producing a honeycomb structure by continuously extruding the honeycomb structure in the gravity direction, but the basic operation is the same as in the apparatus for producing a honeycomb structure by extruding in the oblique direction at an angle of smaller than 30° with the gravity direction.

As shown in FIGS. 2(*a*)–(*c*), in the production apparatus 50 of the present invention, an extruder 1 is provided so that an extrusion direction P is the gravity direction or the like, and a honeycomb structure 10 extruded from the extruder 1 is such that the direction of application of its own weight is the lengthwise direction of cell walls in which the highest strength against mainly the own weight is obtained.

Next, in the production apparatus 50 of the present invention, a cradle 3 is moved by a cradle moving part 5 to just below a cell opening end face 9 of the honeycomb structure 10 extruded from the extruder 1, and the honeycomb structure 10 is placed on the cradle 3 (in the drawing, shown is a suitable example where a carrying pallet 17 is provided on the cradle 3 and the honeycomb structure 10 is placed thereon), whereby the inherent attitude can be stably maintained. Moreover, in the production apparatus 50 of the present invention, the honeycomb structure 10 is placed with its cell opening end face 9 being supported by the cradle, which is structurally strongest in the honeycomb structure.

Movement of the cradle 3 to just below the cell opening end face 9 can be started according to sensing of the change of load generated at the time of completion of cutting by a load sensor 7 which senses the load applied to the cradle 3.

In the production apparatus 50 of the present invention, next, the cradle 3 having the honeycomb structure 10 placed thereon is moved, for example, in the same direction as the lengthwise direction Z of the honeycomb structure 10 and at nearly the same speed as the extrusion speed in the lengthwise direction by the cradle moving part 5 according to the information such as the extrusion speed of the honeycomb structure in the lengthwise direction or the like obtained by a speed sensor 6, whereby the honeycomb structure 10 which becomes longer with lapse of time can be placed on the cradle 3 from the time of the honeycomb structure being short in size to the time of completion of cutting.

Furthermore, in the production apparatus 50 of the present invention, the cutting device 2 is also moved nearly synchronously with the movement of the cradle 3 in the same direction and at nearly the same speed as the cradle 3 based on the information of the speed sensor 6 or the like, whereby it becomes possible to perform the desired cutting of the honeycomb structure in the diameter direction or the like while continuously extruding the honeycomb structure.

Furthermore, in the production apparatus 50 of the present invention, as shown in FIGS. 3(*a*)–(*c*) and FIG. 4, while moving in the lengthwise direction Z, the cutting device 2 is moved to the side of the honeycomb structure 10 on the plane 26 including the cutting stretched small-gage wire 25 and notching position of the honeycomb structure (the position at which an induction groove 15 is formed), and immediately after the induction groove 15 is formed by a notching member 23, the cutting small-gage wire 25 is positioned in the induction groove 15 and the cutting small-gage wire 25 is inserted into the honeycomb structure 10 as it is to cut the honeycomb structure 10 in the diameter direction or the like.

In the production apparatus 50 of the present invention, by such a sequence of operations of the cutting device 2, the cutting can be completed in a very short time after the honeycomb structure has reached a desired length without substantially no time lag from the formation of the induction groove 15 by the notching member 23 until the honeycomb structure 10 is cut by the cutting small-gage wire. As a result, even when the honeycomb structure 10 is extruded in the gravity direction or the like, it can be cut before it becomes unstable against the force in the diameter direction, and failure in molding can be markedly reduced.

Though not shown in FIG. 2, after completion of cutting of the honeycomb structure 10, for example, the cradle 3 having thereon the honeycomb structure 10 after cut moves to the position where the honeycomb structure is placed on the carrying machine 16 in accordance with the information from the load sensor 7, and the honeycomb structure 10 is transferred onto the carrying machine 16 (in the apparatus shown in FIG. 2, the honeycomb structure 10 is transferred onto the carrying machine 16 together with a carrying pallet 17 having the honeycomb structure). Then, after lifting to the position at which the cradle is provided at the cell opening end face 9 of the honeycomb structure 10 (in FIG. 2, lifting occurs after picking up a new carrying pallet 17 from the carrying machine 16), for example, based on the information from the load sensor 7 or the like, the cradle 3 is again put at the cell opening end face 9 of the honeycomb structure 10 extruded freshly from the extruder 1.

DESCRIPTION OF REFERENCE NUMERALS

Figure 1:
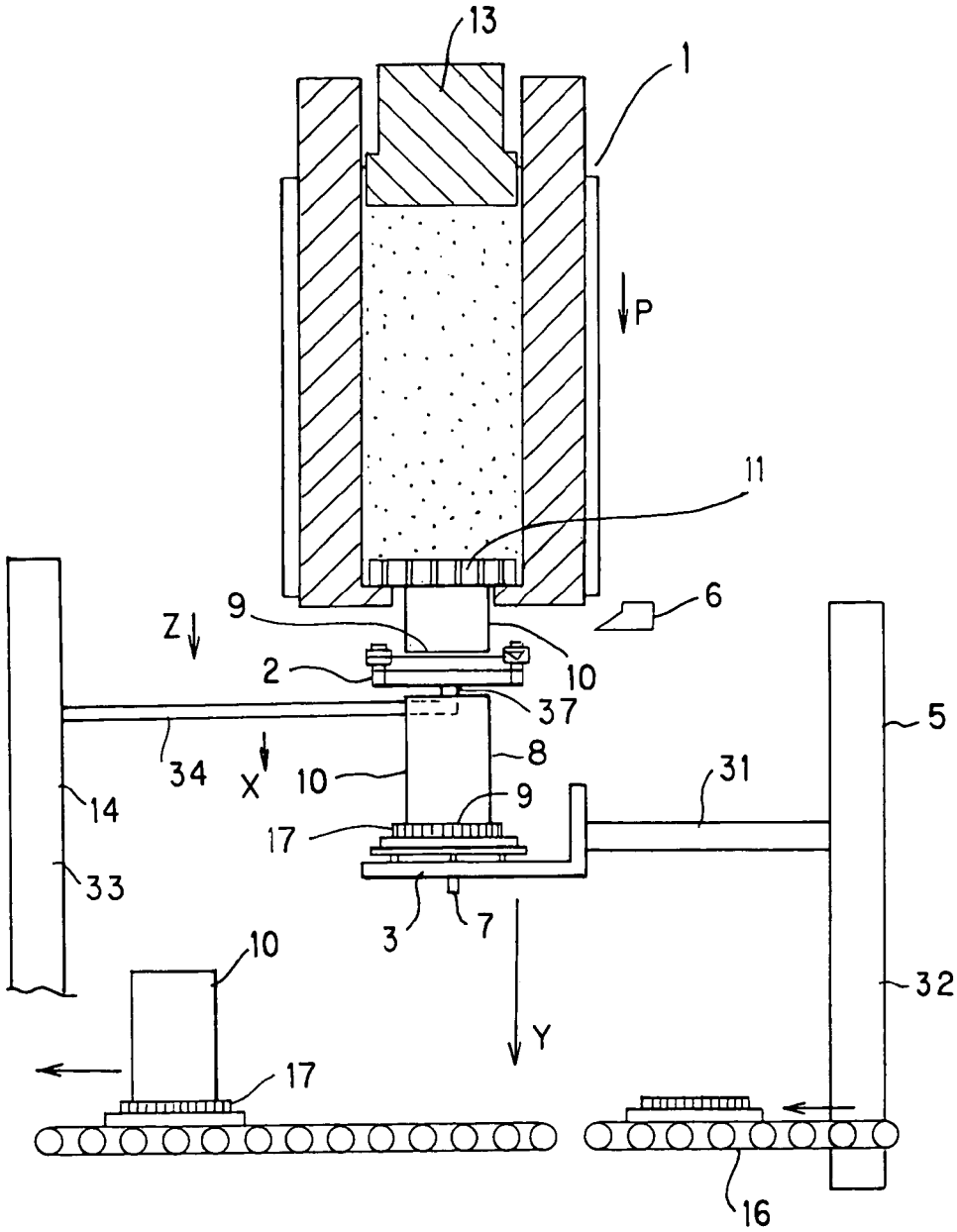
FIG. 1 is a schematic view which shows operation state of the main parts of the production apparatus according to the present invention.
Figure 2C:
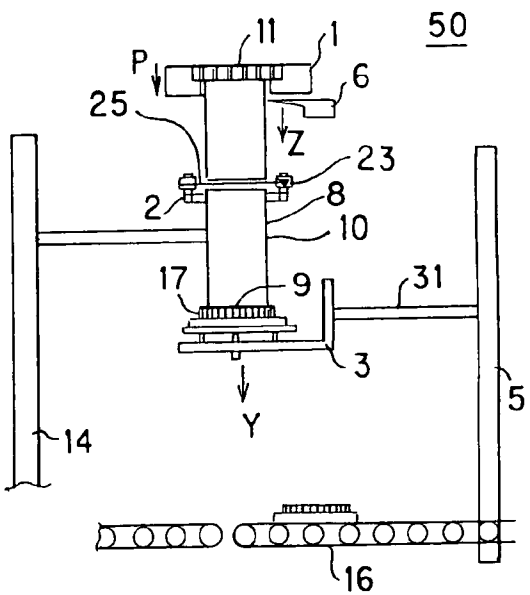
FIGS. 2(*a*)–(*c*) show a flow sheet which illustrates in sequence of steps the operation of the main parts of the production apparatus according to the present invention.
Figure 2B:
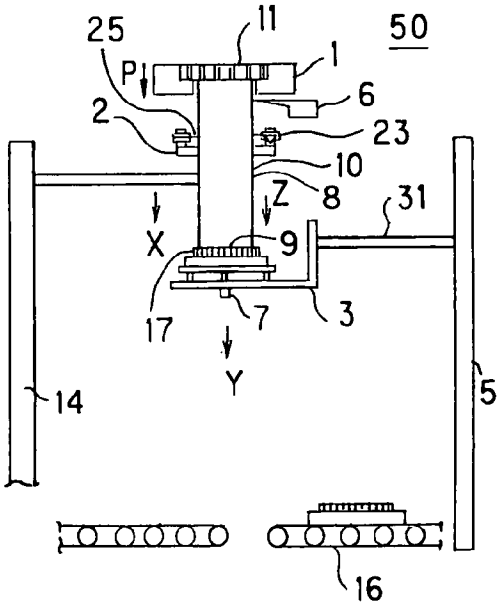
Figure 2A:
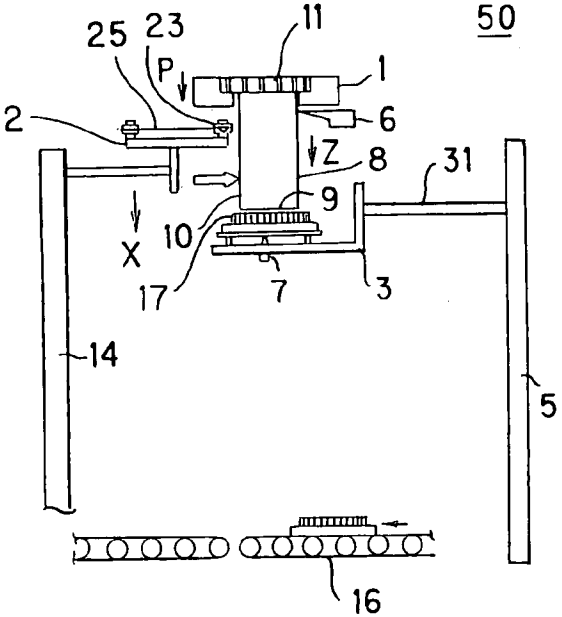

The following reference numerals used in the accompanying drawings indicate the following components of the apparatus.

1 - - - Extruder, 2 - - - Cutting device, 3, 4 - - - Cradles, 5 - - - Cradle moving part, 6 - - - Speed sensor, 7 - - - Load sensor, 8 - - - Outer peripheral side surface, 9 - - - Cell opening end face, 10 - - - Honeycomb structure, 11 - - - Die, 11*a* - - - Substrate, 11*b* - - - Slit, 11*c* - - - Introducing hole for puddle, 13 - - - Extruding mechanism for puddle, 14 - - - Cutting device moving part, 15 - - - Induction groove, 16 - - - Carrying machine, 17 - - - Carrying pallet, 20 - - - Frame body, 21 - - - Arm part, 22 - - - Rotating member, 23 - - - Notching member, 24 - - - Driving part, 25 - - - Small-gage wire for cutting, 26 - - - Plane including the stretched wire, 27 - - - Notching position, 31 - - - Arm member, 32 - - - Lifting member, 33 - - - Main body, 34 - - - Arm member, 35 - - - Auxiliary part, 37 - - - Lifting member, 41 - - - Pedestal part, 42 - - - Spring, 43 - - - Main body, 45 - - - Air cylinder, 46 - - - Air cushion, 47 - - - Load cell, 50 - - - Apparatus for producing (honeycomb structure)

BEST MODE FOR CARRYING OUT THE INVENTION

Embodiments of the present invention will be explained in more specifically on the respective constituents referring to the drawings.

Figure 5:
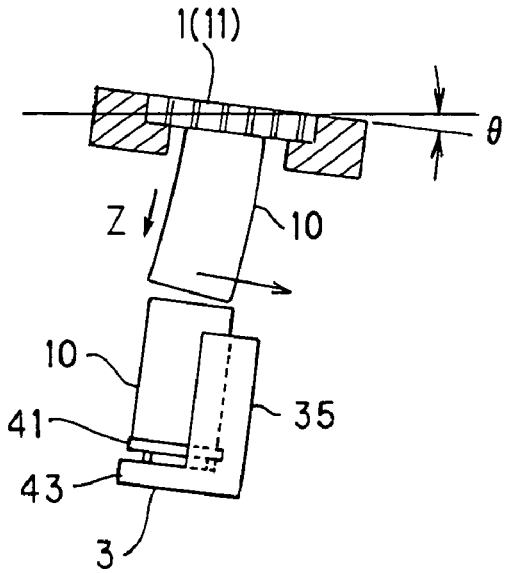
FIG. 5 is a schematic view which shows an embodiment of extruding the honeycomb structure in an oblique direction in the production apparatus of the present invention.

As shown in FIG. 1, FIG. 5, etc., the extruder 1 in the present invention is provided so that the extrusion direction P is a gravity direction or an oblique direction at an angle of 30° with the gravity direction as mentioned above. Thus, in the molded honeycomb structure 10, its own weight is mainly applied in the lengthwise direction of cell walls which structurally has the highest strength, and hence even when a thin-walled and/or large-sized honeycomb structure 10 is produced, this can be produced without causing distortion in outer wall and/or cell walls of the honeycomb structure 10.

In the present invention, the extrusion direction P of the honeycomb structure in the extruder 1 is preferably the gravity direction in which the own weight is applied only in the lengthwise direction of cell walls of the honeycomb structure, but in case the bend of the honeycomb structure 10 caused by the characteristics of the extruder is corrected utilizing the own weight of the honeycomb structure, the extrusion direction of the honeycomb structure may be tilted at a desired angle as shown in FIG. 5.

As the extruder 1 in the present invention, there can be mentioned one which has a die 11 and an extruding mechanism 13 for puddle.

Figure 7B:
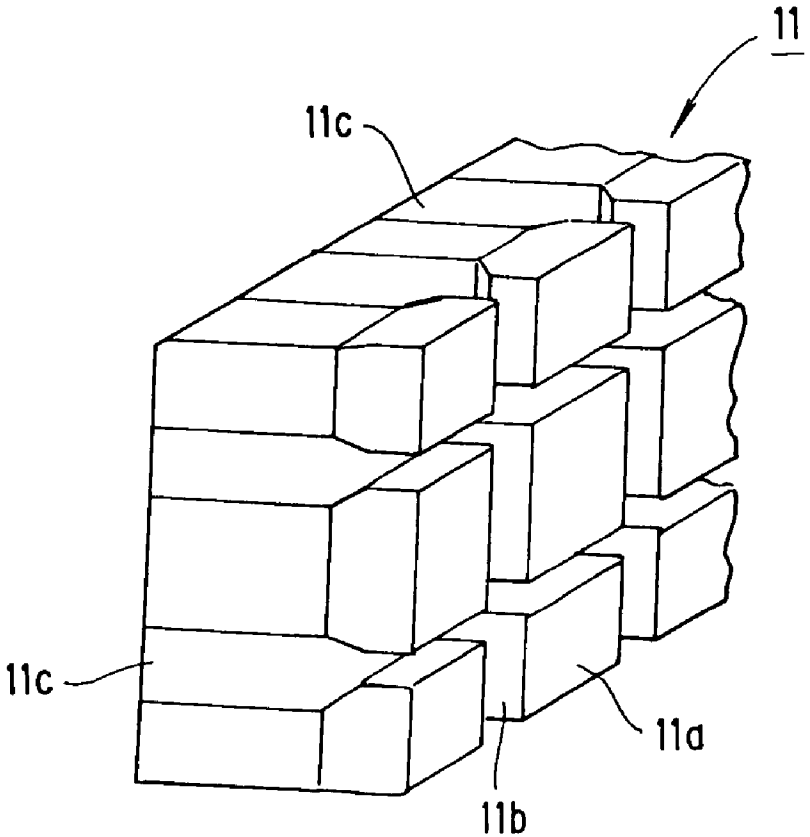
FIG. 7(*a*) is a top view which shows one example of a die used in the extruder in the present invention and (b) is an oblique view which shows one part of the die.
Figure 7A:
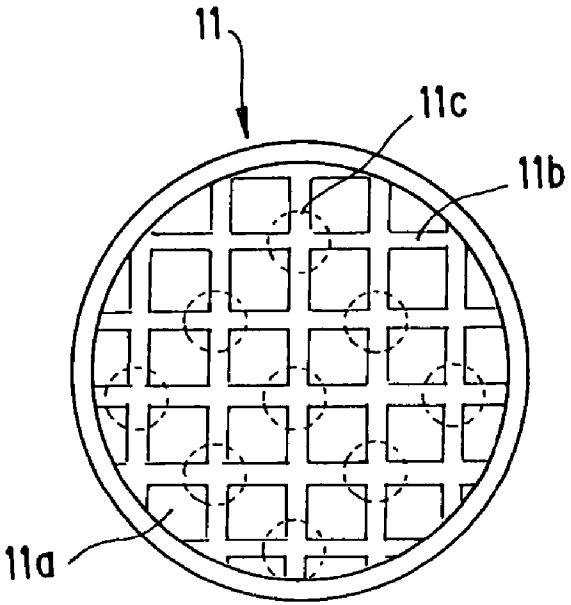

As shown in FIGS. 7(*a*)(*b*), as the die 11, mention may be made of one which has slits 11*b* such as lattice slits on the extrusion side of a substrate 11*a* such as disc-shaped substrate 11*a* and introduction holes 11*c* for puddle on the side of the substrate opposite to the extrusion side, the introduction holes 11*c* for puddle communicating with the slits 11*b* at the positions where the slits 11*b* cross each other inside the substrate 11*a*.

Usually, the thickness of the cell walls of the honeycomb structure is adjusted by the width of the slits 11*b*. For example, for producing a honeycomb structure having cell walls of 0.05 mm in thickness, a die having a slit width of usually 0.05–0.055 is employed.

Furthermore, as shown in FIG. 1, the extruding mechanism 13 for puddle is, for example, one which has a cylinder structure, but may be one in which a plurality of screws are provided to continuously carry out kneading of raw material and extrusion of the puddle.

Next, the cradle 3 in the present invention is constructed so that it can hold thereon the honeycomb structure 10 extruded from the extruder 1 with its cell opening end face 9 being supported by the cradle and can be moved as it is in the lengthwise direction Z of the honeycomb structure 10 at nearly the same speed as the extrusion speed of the honeycomb structure in the lengthwise direction.

Thus, the cradle 3 can support the honeycomb structure 10 extruded in the gravity direction or the like in the state of the highest strength being obtained.

Furthermore, by holding the honeycomb structure with its cell opening end face 9 being supported by the cradle, for example, the shape of the member holding the honeycomb structure, such as a carrying pallet 17 mentioned below, need not conform to the shape of the honeycomb structure to be produced whenever it changes, and as a result, the apparatus can be simplified. Moreover, basically, due to the presence of the cradle 3, the cutting position is not limited and honeycomb structures of different length can be produced while continuously carrying out the operation.

The cradle 3 in the present invention can be one which has a pedestal part 41 corresponding to the cell opening end face 9 of the honeycomb structure 10, but, if necessary, there may be provided a carrying pallet 17 comprising a cell structure corresponding to the cell opening end face 9, a cell structure larger in opening area than the cell opening end face 9 or a porous body.

By providing such carrying pallet 17, since the respective cells can be avoided from being closed by the surface of the cradle on which the honeycomb structure is placed when the honeycomb structure 10 is placed with its cell opening end face 9 being supported by the cradle, the pressure in the cells is not lowered by the extrusion and defects such as rupture of the cells due to vacuum caused by the lowering of pressure can be avoided.

Furthermore, as shown in FIG. 5, when the extrusion direction is an oblique direction at an angle of 30° with the gravity direction, it is also preferred that in addition to the pedestal part 41, an auxiliary part 35 having a supporting face corresponding to a part of the outer peripheral side surface 8 to which own weight is applied may be provided at the main body 43 or the pedestal part 41 (the drawing shows an example of providing it at the main body), whereby the cradle 3 may hold the honeycomb structure 10 with its cell opening end face 9 and its outer peripheral side surface 8 being supported by the cradle. Thus, since a part of the own weight of the honeycomb structure 10 can also be supported by the outer peripheral side surface 8 during extrusion molding, the honeycomb structure 10 is placed at more stable state and failure of molding can be highly inhibited.

Figure 6:
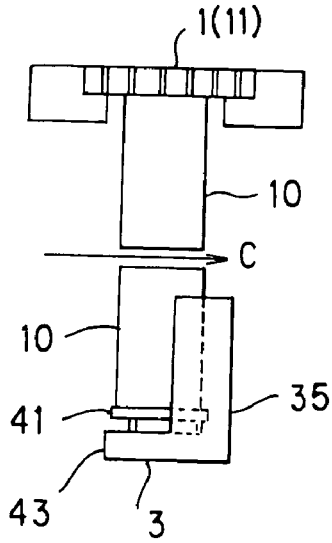
FIG. 6 is a schematic view which shows an embodiment of extruding the honeycomb structure in the gravity direction in the production apparatus of the present invention.

Furthermore, as the cradle 3 in the present invention, even when the extrusion direction is the gravity direction as shown in FIG. 6, it is also preferred that in addition to the pedestal part 41 provided corresponding to the cell opening end face 9 of the honeycomb structure 10, an auxiliary part 35 having a supporting face corresponding to a part of the outer peripheral side surface 8 may be provided at the main body 43 or the pedestal part 41 (the drawing shows an example of providing it at the main body). When such cradle 3 is used, distortion of the honeycomb structure 10 at the time of cutting can be highly inhibited, and the effect is especially high in the case of producing honeycomb structure 10 having a high open frontal area or a large length/diameter ratio.

The supporting surface of the auxiliary part 35 may not necessarily completely conform to the configuration of the outer peripheral side surface 8 of the honeycomb structure 10, but it is a matter of course that the supporting surface preferably completely conforms to the configuration of the outer peripheral side surface 8.

Figure 13C:
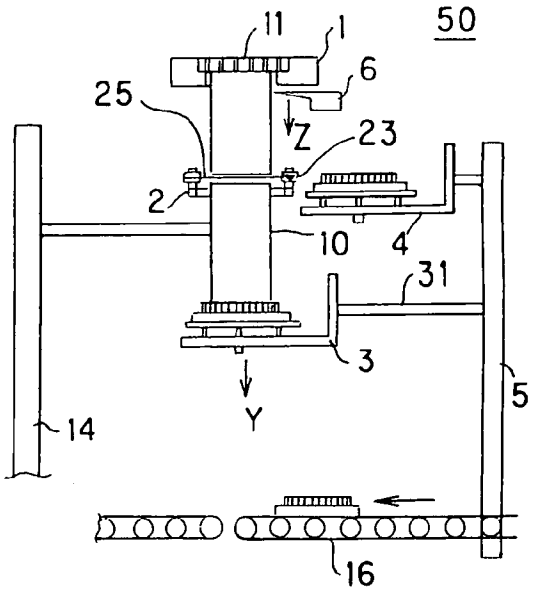
FIGS. 13(*a*)–(*c*) show a flow sheet which illustrates in sequence of steps the operation of the main parts of the production apparatus of another embodiment according to the present invention.
Figure 13B:
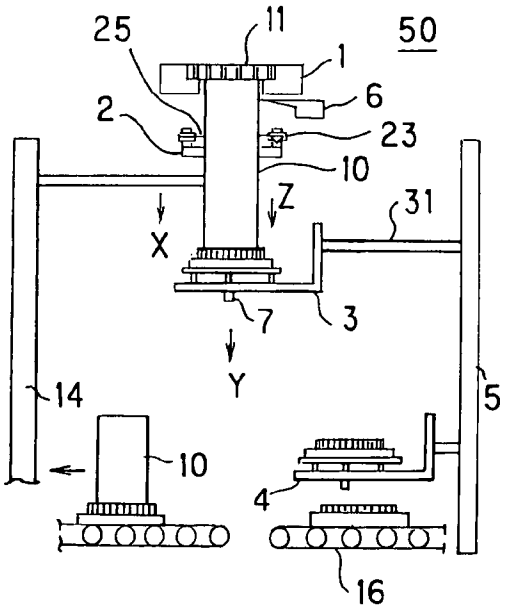
Figure 13A:
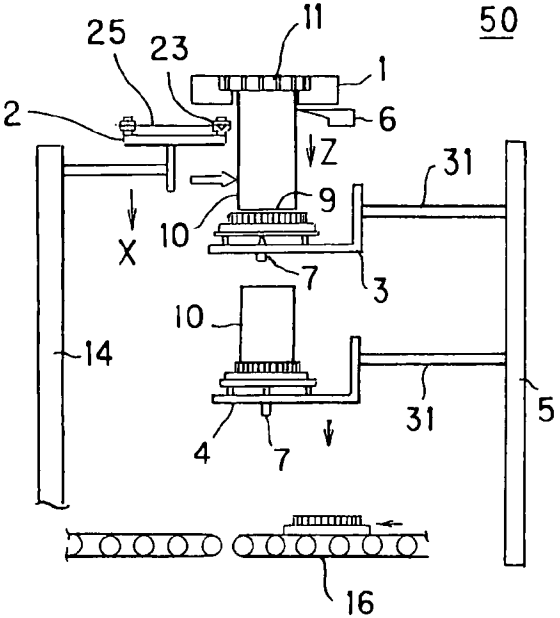

As shown in FIG. 1, the cradle 3 in the present invention may be only one, but in the case of the production apparatus by continuous extrusion, it is preferred that at least two of the cradles 3, 4 are provided and a series of operations for the production of honeycomb structure 10 are independently carried out as shown in FIGS. 13(*a*)–(*c*). Specifically, it is preferred that after completion of cutting, one cradle 4 holding the cut honeycomb structure 10 is moved by a cradle moving part 5 to the position where the cut honeycomb structure 10 is transferred onto the carrying machine 16, and after transferring the honeycomb structure 10 onto the carrying machine 16, the cradle 3 is on standby at a given position, and on the other hand, another cradle 3 which is waiting at the give position is moved by the cradle moving part 5 to the position where the cell opening end face 9 of the freshly extruded honeycomb structure 10 can be received in parallel with the operations of the-cradle 4, and the cradle 3 holds the honeycomb structure 10 with its cell opening end face 9 being supported by the cradle and moves at nearly the same speed as the extrusion speed of the honeycomb structure 10 in the lengthwise direction and in the same direction as the lengthwise direction Z.

In the apparatus 50 provided with these cradles 3, 4, the honeycomb structure 10 can be molded with being placed on the cradles 3, 4 just after starting of the extrusion, and the apparatus is suitable for carrying out the extrusion molding at high speed. In this example, two cradles are provided, but naturally a plurality of two or more of the cradles may be provided.

The cradle moving part 5 may be one which can allow the cradle 3 to perform the above mentioned desired operations, and, as shown in FIG. 1, as example thereof, mention may be made of one which has an arm member 31 which is connected to the cradle 3 and has such structure as capable of being extended and contracted in a direction perpendicular to the extrusion direction of the honeycomb structure 10 and a lifting member 32 which moves up and down the arm member 31 in the extrusion direction of the honeycomb structure 10. The mechanism used for moving the cradle in the cradle moving part 5 may be a mechanism usually employed for the movement of this kind, and, as examples thereof, mention may be made of various mechanisms such as air cylinder type, hydraulic type and belt type.

The controlling means of the cradle moving part 5 can also be one which allows the cradle 3 to perform the desired operations, and, for example, may be one which operates the cradle 3 by driving the cradle moving part 5 in accordance with the instructions from a controlling part (not shown) on the basis of a time schedule relating to the operation of the cradle 3 which is set in the controlling part.

In order to carry out the control more precisely, such as moving of the cradle 3 in correspondence with change of extrusion speed in lengthwise direction of honeycomb structure 10, it is preferred to sense the necessary information in real time by various sensors and to drive the cradle moving part based on the information.

As the sensors, mention may be made of a sensor which can sense the time at which the honeycomb structure 10 is placed on the cradle 3 as one which starts the movement of a cradle 2 in lengthwise direction Z of the honeycomb structure at the time of placing the honeycomb structure 10, and a sensor which can sense the information necessary for movement such as extrusion speed in lengthwise direction of the honeycomb structure 10 as one which is for moving the cradle 3 at nearly the same speed as the extrusion speed in the lengthwise direction of the honeycomb structure 10 after starting of the cradle 3 in the direction Z. Furthermore, mention may be made of one which can sense completion of the cutting in order to start the movement of the cradle to the position at which the cradle is transferred after completion of cutting and moreover to start the movement of the cradle to the cell opening end face 9 of the newly extruded honeycomb structure 10.

In the present invention, as a sensor which senses the time at which the honeycomb structure 10 is placed, there may be mentioned a load sensor 7 which senses the change of load caused at the time of placing the honeycomb structure 10 on the cradle 3 as shown in FIG. 1.

Furthermore, as a sensor which senses the information for moving the cradle 3 at a desired speed, in addition to the speed sensor 6 which measures the extrusion speed in the lengthwise direction of the honeycomb structure 10, there may be mentioned the load sensor 7 which senses the change of load applied to the cradle 3 which is caused due to the difference between the moving speed of the cradle 3 after starting of the movement and the extrusion speed in the lengthwise direction of the honeycomb structure 10 (FIG. 1 shows an example of carrying out adjustment of speed of the cradle 3 by the speed sensor 6, but the speed adjustment of the cradle 3 may be carried out by the load sensor 7). In the case of the speed sensor 6, the cradle 3 can be moved at the same speed based on the sensed extrusion speed in the lengthwise direction, and in the case of the load sensor 7, the cradle 3 can be moved so that the change of load is within the desired range based on the sensed change of the load. Moreover, when the speed sensor 6 is applied, the time at which the length of the honeycomb structure 10 reaches the desired length can also be sensed by integrating the resulting extrusion speed in lengthwise direction with speed sensing time, and hence the starting of the movement in the direction perpendicular to the lengthwise direction Z of the honeycomb structure 10 at a cutting device 2 mentioned hereinafter can also be controlled by the same sensor.

Furthermore, as sensors which sense completion of cutting, mention may be made of one which senses completion of operation in the direction perpendicular to the lengthwise direction Z of the honeycomb structure at the cutting device 2, one which senses completion of cutting by the change of torque of driving part in the cutting device where the cutting small-gage wire is connected to the driving part, and the like. However, from the point that erroneous sensing caused by deflection or breakage of the small-gage wire for cutting can be avoided, preferred is the load sensor 7, more specifically, one which indirectly senses the abrupt changes of load applied to the cradle 3 produced at the time of completion of cutting of the honeycomb structure 10 by spring displacement, inner pressure displacement such as air cylinder or air cushion, or bending displacement of piezoelectric element.

As is clear from the above, according to the load sensor 7, information which is necessary for controlling the operation of cradle 3 can be sensed by one sensor and the similar control can also be performed for the cutting device 2. Moreover, as mentioned hereinafter, since sensing of completion of cutting is possible, starting of operation of the cradle 3 and the like after completion of cutting can be controlled. However, if a speed sensor 6 is used, the cradle 3 can be moved more rapidly responding to the increase of length of the honeycomb structure 10, and hence it is also preferred to use the load sensor 7 and the speed sensor 6 in combination.

In the present invention, the speed sensor 6 may be those which are based on any principle, but from the points that the limitation in setting position is small and that the sensing speed is high, and the cradle 3 can be moved rapidly responding to the extrusion speed in lengthwise direction of the honeycomb structure 10, preferred are those which can sense the extrusion speed in lengthwise direction of the honeycomb structure 10 in non-contact state by calculating the speed based on the change in wavelength of laser beams or ultrasonic waves emitted to the honeycomb structure 10 depending on the extrusion speed of the surface of the honeycomb structure 10.

Furthermore, the load sensor 7 may be those which are based on any principle, and mention may be made of, for example, those which sense the load applied to the cradle 3 utilizing displacements of various elastic bodies, such as spring displacement, inner pressure displacement, bending displacement of piezoelectric element, and the like.

Moreover, as shown in FIGS. 8–11, in the case of sensing the load applied to the cradle 3 utilizing the displacement of various elastic bodies, it is preferred to provide the cradle 3 with the load sensor 7 which is constituted of a sensor main body 43 connected to the cradle moving part 5, a pedestal part 41 movably provided on the main body 43, and an elastic body such as a spring 42 provided between the main body 43 and the pedestal part 41, and which senses the load applied to the pedestal part 41 by displacement of the elastic body such as the spring 42.

Figure 12:
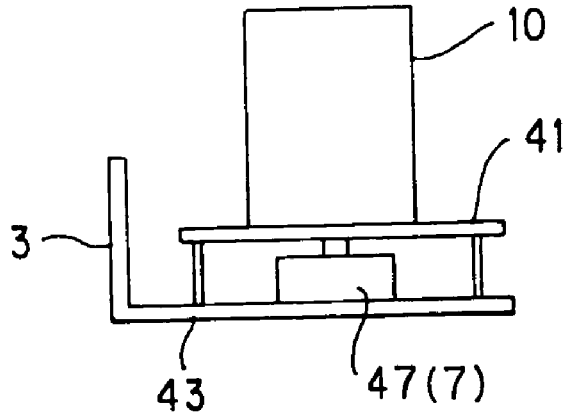
FIG. 12 is a schematic view which shows another example of the load sensor in the present invention.

Similarly, as shown in FIG. 12, in the case of sensing the load applied to the pedestal part 41 utilizing the displacement of piezoelectric body, it is preferred to provide the cradle 3 with the load sensor 7 (47) which is constituted of the sensor main body 43 connected to the cradle moving part 5 and the pedestal part 41 movably provided on the main body 43, and which senses the load applied to the pedestal part 41 by the bending displacement of the piezoelectric body.

In the case of such a construction as sensing the load applied to the pedestal part 41 utilizing the displacement of various elastic bodies as shown in FIGS. 8–11, breakage and the like of the honeycomb structure 10 when it is placed by the cradle 3 can be markedly diminished by the cushioning action of the elastic body in addition to exhibiting the function as the load sensor 7. Further, even when there occurs some slippage between the movement of the cradle 3 and the extrusion speed in lengthwise direction of the honeycomb structure 10, a proper pressing state to the honeycomb structure 10 can be maintained.

Figure 8:
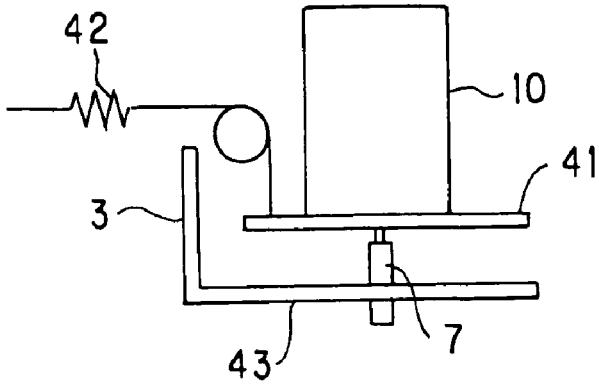
FIG. 8 is a schematic view which shows one example of the load sensor in the present invention.
Figure 9:
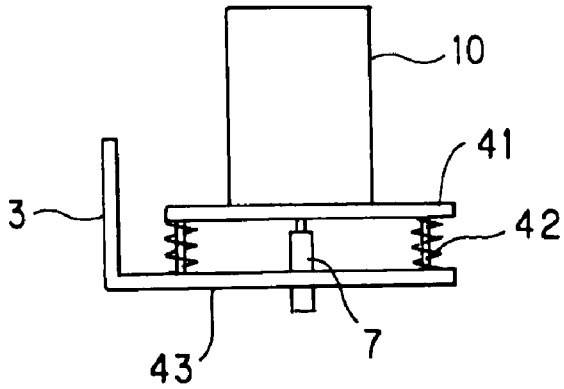
FIG. 9 is a schematic view which shows another example of the load sensor in the present invention.

In the present invention, as examples of utilizing the displacement of the elastic body, mention may be made of one in which the cradle 3 is constituted of the sensor main body 43 connected to the cradle moving part, the pedestal part 41 provided on the main body 43 in movable state in the extrusion direction and the spring 42 pulling the pedestal part 41 in the direction opposite to the extrusion direction by a given force, and the load sensor 7 is constituted of a sensor which senses the displacement of elongation of the spring 42 caused when the extended honeycomb structure 10 presses the pedestal part 41, as shown in FIG. 8, and one in which the cradle 3 is constituted of the sensor main body 43 connected to the cradle moving part, the pedestal part 41 provided on the main body 43 in movable state in the extrusion direction and the spring 42 provided between the main body 43 and the pedestal part 41, and the load sensor 7 is constituted of a sensor which senses the displacement of contraction of the spring 42 caused when the extended honeycomb structure 10 presses the pedestal part 41, as shown in FIG. 9.

The former sensor is preferred for sensing the change in small load since it utilizes displacement of elongation of the spring, and the latter sensor is preferred in the case of a large load being applied since it utilizes displacement of contraction of the spring.

Figure 10:
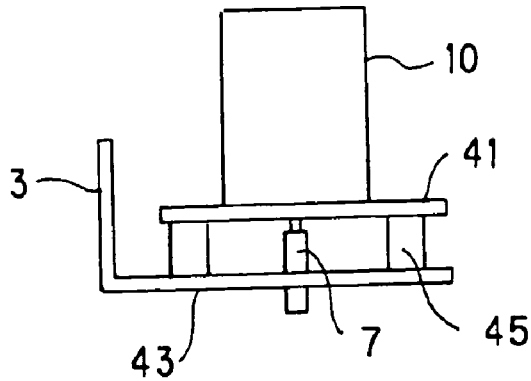
FIG. 10 is a schematic view which shows another example of the load sensor in the present invention.
Figure 11:
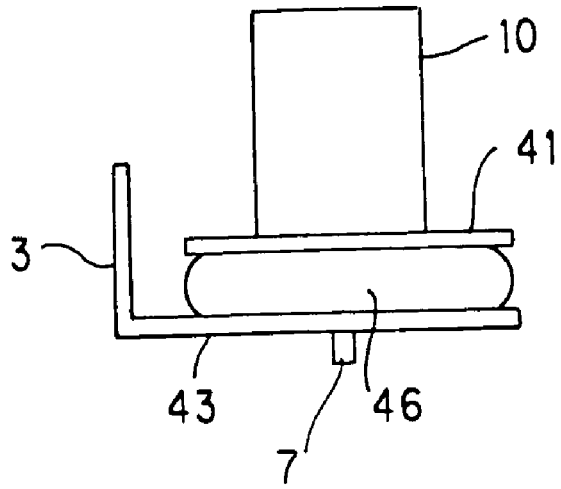
FIG. 11 is a schematic view which shows another example of the load sensor in the present invention.

Another example is one in which the cradle 3 is provided with an air cylinder 45 in place of the spring between the pedestal part 41 and the sensor main body 43, and the load sensor 7 comprises a sensor which senses the displacement of inner pressure of the air cylinder 45 caused when the extended honeycomb structure 10 presses the pedestal part 41, as shown in FIG. 10, or one in which the cradle 3 is provided with an air cushion 46 in place of the spring between the pedestal part 41 and the sensor main body 43, and the load sensor 7 comprises a sensor which senses the displacement of inner pressure of the air cushion 46 caused when the extended honeycomb structure 10 presses the pedestal part 41, as shown in FIG. 11.

According to the example of providing air cylinder 45, since the cylinder pressure can be easily changed, not only honeycomb structures 10 of different weight can be produced by one apparatus, but also honeycomb structures 10 of different weight can be continuously produced if the change of cylinder pressure is automatically controlled depending on the weight of the extruded honeycomb structures 10. Furthermore, in all of the examples, the face pressure of the pedestal part 41 can be set non-linearly with regard to the displacement of the cylinder pressure, and the honeycomb structure 10 can be softly contacted with the pedestal part 41 when the honeycomb structure 10 is placed on the cradle 3, whereby breakage such as chipping can be inhibited.

In the present invention, as an example of utilizing the displacement of a piezoelectric body, mention may be made of one in which the cradle 3 is constituted of the sensor main body 43 connected to the cradle moving part and the pedestal part 41 provided on the main body 43 in movable state in the extrusion direction, and the load sensor 7 is constituted of a load cell 47 provided between the main body 43 and the pedestal part 41, and such construction is preferred in the case of a large load is applied as shown in FIG. 12.

Figure 3A:
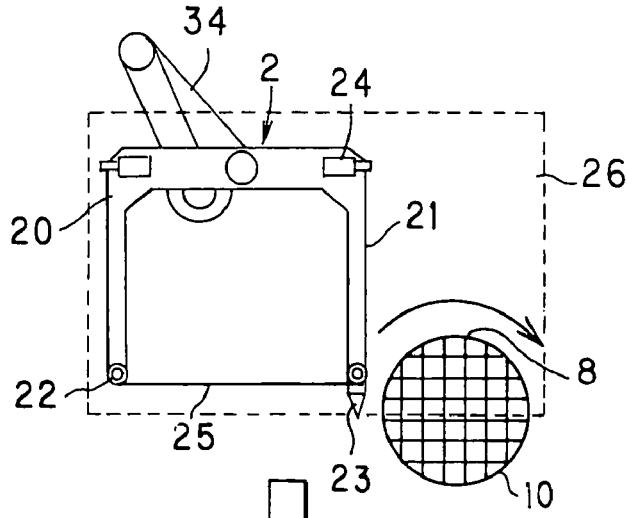
FIGS. 3(*a*)–(*c*) show a flow sheet which illustrates in sequence of steps a series of cutting operations of the cutting device in the present invention.
Figure 3B:
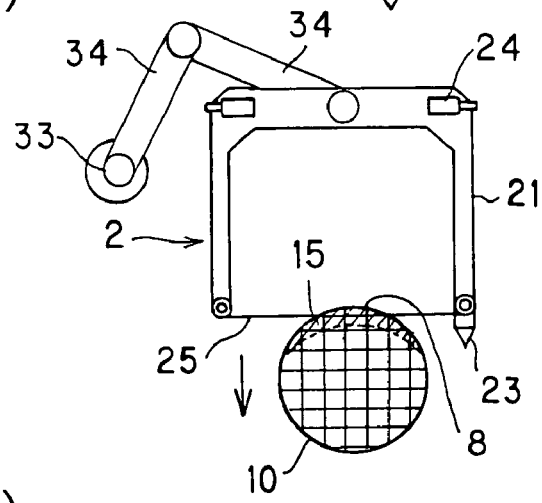
Figure 3C:
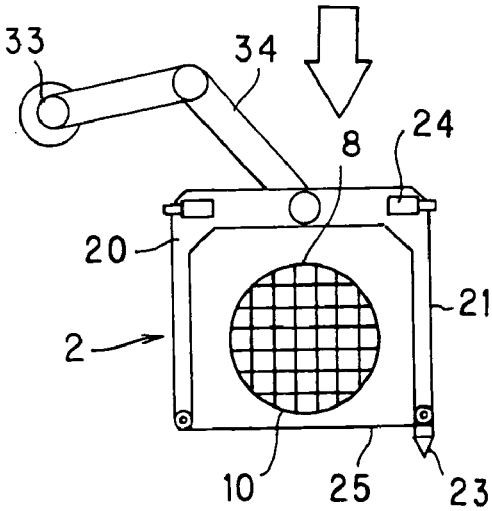
Figure 4:
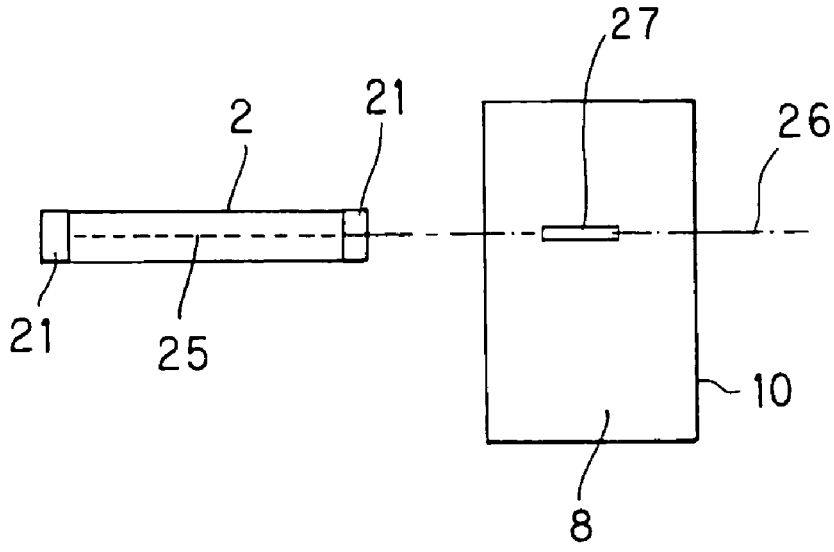
FIG. 4 is a side view of the cutting device in the present invention which schematically shows a positional relation between the cutting small-gage wire and notching position (induction groove).
Figure 14:
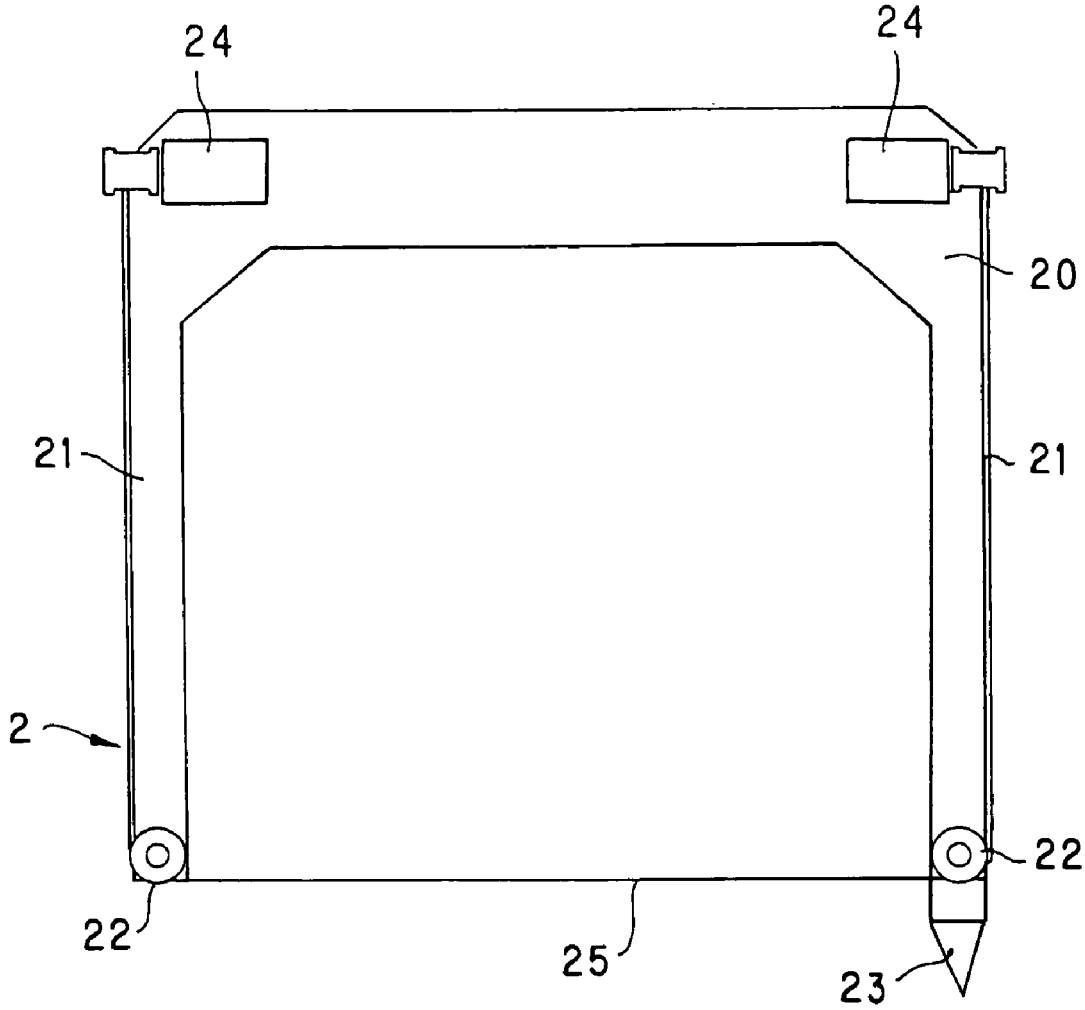
FIG. 14 is a side view which shows one example of the cutting device in the present invention.

Next, as shown in FIG. 14, FIGS. 3(*a*)–(*c*), and FIG. 4, the cutting device 2 in the present invention has a frame body 20, a cutting small-gage wire 25 stretched on the frame body 20, and a notching member 23 set with a notching position 27 for the honeycomb structure 10 on the same plane 26 as the cutting small-gage wire 25 stretched on the frame body 20. Furthermore, as shown in FIGS. 3(*a*)–(*c*) and FIG. 4, the cutting device 2 moves to the side of the honeycomb structure 10 on the plane 26 in which the notching position of the notching member 23 and the cutting small-gage wire 25 are present, thereby forming an induction groove 15 on the outer peripheral side surface 8 of the honeycomb structure 10 and immediately thereafter the cutting small-gage wire 25 is positioned in the induction groove 15 and the cutting small-gage wire 25 as it is, is inserted into the honeycomb structure 10 to cut the honeycomb structure 10.

Thus, it becomes possible to cut the honeycomb structure 10 by the cutting small-gage wire 25 immediately after the formation of the induction groove 15, and the cutting can be completed in a very short time after the honeycomb structure 10 is extended to the necessary minimum length.

As shown in FIG. 3 and others, the notching member 23 in the present invention can be any ones which can form the induction groove 15 at a depth of about 3 cells in the direction of diameter of the honeycomb structure 10, and, for example, cutting means such as knives, rotating blades, laser, and water jet can be used.

Furthermore, when a knife or a rotating blade is used as the notching member 23, the notching member can be provided with positioning the tip of the knife or blade on the plane 26 including the stretched cutting small-gage wire 25, and when a laser or water jet (hereinafter referred to as "laser, etc.") is used as the notching member 23, the laser, etc. can be provided so that the portion of the outer peripheral side surface of the honeycomb structure with which the laser, etc. contact is positioned on the plane including the stretched cutting small-gage wire. The fixing position of the notching member 3 is not particularly limited, and it can be fixed at any positions as far as the notching position is set at the above-mentioned specific position.

In the present invention, the induction groove 15 formed by the notching member 3 need to have a width of 0.2 mm or more in which the cutting small-gage wire 25 can be inserted, and, therefore, the width of the laser, etc. and the knife or rotating blade is preferably in the range corresponding to the width of the induction groove 15.

Among the above cutting means, when a knife is used, it is preferred that the thickness of the knife is preferably 0.5–2 mm so as to form such a groove width that the cutting small-gage wire 25 can be surely inserted into the induction groove 15 and so as not to cause distortion of the honeycomb structure 10 due to the resistance at the time of forming the induction groove 15. Material of the knife is preferably such as having high rust prevention, and besides being capable of maintaining the rigidity of the notching member with the above thickness.

When the induction groove 15 is formed by a knife or rotating blade, the cutting speed is preferably 20–150 mm/sec. If it is less than 20 mm/sec, the cutting efficiency is reduced, and if it exceeds 150 mm/sec, distortion sometimes occurs in the honeycomb structure 10 in relation to thickness of cell walls.

Next, as shown in FIG. 14, the frame body 20 is preferably one which has two or more arm parts, and, for example, mention may be made of U-shaped frame body in which the cutting small-gage wire 25 is stretched over two arm parts 21. Two arm parts 21 are sufficient, but the more arm parts 21 can be provided.

The cutting small-gage wire 25 is of material capable of cutting the honeycomb structure, and, furthermore, preferably has a diameter of as small as possible so as not to apply a large force to the honeycomb structure in the diameter direction. Specifically, the wire is preferably made of steel and has a diameter of about 0.1–0.05 mm. Moreover, in the present invention, the cutting small-gage wire 25 may be fixedly stretched between the arm parts 21 of the frame body 20 or may be one whose both ends are connected to the driving part 24 to be moved in the direction of stretching. Further, in the latter case, it is preferred that a rotating member 22 is provided at the tip of each arm part 21 of the frame body 20, and the cutting small-gage wire 25 is stretched between the rotating members 22 and each end of the cutting small-gage wire 25 is connected to the driving part 24, which pulls each end of the cutting small-gage wire 25, thereby moving the cutting small-gage wire 25 stretched between the rotating members 22 in its stretching direction.

Thus, since the honeycomb structure can be cut accompanied by movement in the stretching direction of the cutting small-gage wire 25, the cutting resistance at the time of cutting the honeycomb structure 10 is diminished, and distortion of outer shape or distortion of cell walls such as twisting of cells and mesh creasing of the honeycomb structure 10 can be inhibited. Furthermore, since cutting is carried out using always different portions of the cutting small-gage wire 25, it can be avoided to cut a fresh honeycomb structure by the portion stained at the preceding cutting step, and deterioration of the cutting small-gage wire 25 caused by repeated cutting can be prevented, and thus the life of very small-gage wire 25 can be much prolonged.

In the present invention, the cutting small-gage wire 25 stretched between the rotating members 22 may be reciprocated in its stretching direction by alternately pulling the end portions of the cutting small-gage wire 25 by the driving part 24, or the cutting small-gage wire 25 stretched between the rotating members 22 may be moved in only one direction of the stretching direction by pulling one end portion of the cutting small-gage wire 25 by the driving part 24.

Next, as the cutting device moving part 14, mention may be made of one which has the lifting member 37 connected to the cutting device 2 and moving up and down in the lengthwise direction of the honeycomb structure 10, and an arm member 34 having a horizontal articulated structure which is connected movably to the lifting member 37 and can move the cutting device 2 in the direction perpendicular to the lengthwise direction Z of the honeycomb structure 10 while allowing the notching member 23 to contact with outer peripheral side surface 8 of the honeycomb structure (the arm member 34 being fixed to the moving part main body 33 in the case of the cutting device moving part 14 shown in FIG. 1) as shown in FIG. 1 and FIGS. 3(*a*)–(*c*). The lifting member 37 may move up and down the cutting device 2 in the lengthwise direction of the honeycomb structure interlocking with the movement of the cradle 3 by using in common with the lifting member 32 of the cradle moving part 5 mentioned above.

The means for control of the cutting device 2 may be such that the cutting device 2 is desirably operated by previously inputting to a control part the information of extrusion speed in lengthwise direction, length, outer diameter and outer shape of the honeycomb structure 10 and driving each member of the cutting device moving part 14 according to the instructions from the control part based on the information. However, preferably, change of load applied to the cradle 3 caused due to the pressing of the extended honeycomb structure 10 to the cradle is sensed by the above-mentioned load sensor 7, and based on the sensed information, the lifting member 37 is driven to start the movement of the cutting device 2 in the lengthwise direction Z of the honeycomb structure 10. Furthermore, preferably, the extrusion speed in lengthwise direction of the honeycomb structure 10 is sensed by the above-mentioned speed sensor 6 and others, and based on the sensed information and the information of the time lapsing from the starting of the extrusion, the moving speed of the lifting member 37 and the starting time point of operation of the arm member 34 are controlled. Moreover, it is also possible to provide at the frame body 20 a sensor (not shown) which senses the distance from the honeycomb structure 10 and allow the cutting device 2 to carry out desired cutting operation while sensing the distance from the honeycomb structure 10.

In this case, it is preferred to provide at the apparatus a control part (not shown) which controls operation of each member of the cutting device moving part 14 based on the information from the sensors 6, 7 and others, but the control part must not necessarily be provided at the apparatus, and the control can be performed by the same control part.

The apparatus for producing honeycomb structures of the present invention is mainly explained above, and by using the apparatus, the method for producing honeycomb structures of the present invention can be carried out. The materials of the honeycomb structures are not particularly limited, and any materials applicable to honeycomb structures, such as cordierite, SiC and alumina, may be used. Further, the present invention is not limited to the embodiment explained above and includes other embodiments as far as the characteristics are not damaged.

INDUSTRIAL APPLICABILITY

According to the present invention, there can be provided an apparatus for producing honeycomb structures which can continuously produce honeycomb structures having thin cell wall or large outer diameter without causing distortion of outer shape and cell walls, and a method for continuously producing the honeycomb structures.

What is claimed is:

1. An apparatus for producing a honeycomb structure, the apparatus comprising:

an extruder that in operation continuously extrudes a honeycomb structure in at least one of a gravity direction or an oblique direction at an angle of smaller than 30° with the gravity direction;

at least one cradle on which the extruded honeycomb structure is supported and which can move the honeycomb structure; and a movable cutting device, the cutting device further comprising:

a frame body;

a cutting small-gage wire stretched on the frame body; and a separate notching member provided at a position to notch the honeycomb structure on a plane including the stretched cutting small-gage wire, wherein the cradle supports a cell opening end face of the honeycomb structure, and the cradle moves the honeycomb structure in the supported state in a lengthwise direction at substantially a same speed as an extrusion speed in the lengthwise direction of the honeycomb structure, and the cutting device is used to form a cutting induction groove on an outer peripheral side surface of the honeycomb structure by the separate notching member while the cutting device is moved synchronously with the movement of the cradle in the lengthwise direction, and the cutting device is moved to position the cutting small-gage wire in the cutting induction groove after formation of the cutting induction groove, and the honeycomb structure is cut by inserting the cutting small-gage wire into the honeycomb structure.

2. An apparatus for producing a honeycomb structure according to claim 1, the frame body of the cutting device further comprising:

at least two arm members;

a rotating member fitted at the tip of each arm member; and a driving part to which both ends of the cutting small-gage wire are connected, wherein the cutting small-gage wire is stretched between the rotating members, and tension of the cutting small-gage wire is increased by operation of the driving part.

3. An apparatus for producing a honeycomb structure according to claim 1, further comprising a speed sensor which senses the extrusion speed of the honeycomb structure in the lengthwise direction, wherein the speed sensor is not in direct contact with the honeycomb structure, and the speed sensor is usable to send information to at least one of the cradle or the cutting device to move the at least one of the cradle or the cutting device at substantially the same speed as the extrusion speed of the honeycomb structure in the lengthwise direction.

4. An apparatus for producing a honeycomb structure according to claim 2, further comprising a speed sensor which senses the extrusion speed of the honeycomb structure in the lengthwise direction, wherein the speed sensor is not in direct contact with the honeycomb structure, and the speed sensor is usable to send information to at least one of the cradle or the cutting device to move the at least one of the cradle or the cutting device at substantially the same speed as the extrusion speed of the honeycomb structure in the lengthwise direction.

5. An apparatus for producing a honeycomb structure according to claim 1, further comprising a load sensor that senses a load applied to the cradle, wherein when a change of load caused at the time of placing the honeycomb structure on the cradle is sensed by the load sensor, at least one of the cradle or the cutting device are caused to move in the lengthwise direction of the honeycomb structure.

6. An apparatus for producing a honeycomb structure according to claim 4, further comprising a load sensor that senses a load applied to the cradle, wherein when a change of load caused at the time of placing the honeycomb structure on the cradle is sensed by the load sensor, at least one of the cradle or the cutting device are caused to move in the lengthwise direction of the honeycomb structure.

7. An apparatus for producing a honeycomb structure according to claim 5, wherein the load sensor senses a change of load applied to the cradle due to a deviation between the moving speed of the cradle after starting of the movement and the extrusion speed of the honeycomb structure in the lengthwise direction, and adjusts the speed of the at least one of the cradle or the cutting device in response to the sensed deviation.

8. An apparatus for producing a honeycomb structure according to claim 6, wherein the load sensor senses a change of load applied to the cradle due to a deviation between the moving speed of the cradle after starting of the movement and the extrusion speed of the honeycomb structure in the lengthwise direction, and adjusts the speed of the at least one of the cradle or the cradle and the cutting device in response to the sensed deviation.

9. An apparatus for producing a honeycomb structure according to claim 5, wherein the load sensor senses a change of load applied to the cradle completion of cutting of the honeycomb structure and adjusts movement of the cradle having the cut honeycomb structure toward a position at which the honeycomb structure is transferred based on the sensed information.

10. An apparatus for producing a honeycomb structure according to claim 6, wherein the load sensor senses a change of load applied to the cradle at completion of cutting of the honeycomb structure and adjusts movement of the cradle having the cut honeycomb structure toward a position at which the honeycomb structure is transferred based on the sensed information.

11. An apparatus for producing a honeycomb structure according to claim 7, wherein the load sensor senses a change of load applied to the cradle at the time of completion of cutting of the honeycomb structure and adjusts movement of the cradle having the cut honeycomb structure toward a position at which the honeycomb structure is transferred based on the sensed information.

12. An apparatus for producing a honeycomb structure according to claim 8, wherein the load sensor senses a change of load applied to the cradle at completion of cutting of the honeycomb structure and adjusts movement of the cradle having the cut honeycomb structure toward a position at which the honeycomb structure is transferred based on the sensed information.

13. A method for producing a honeycomb structure, the method comprising:

extruding a honeycomb structure from an extruder in at least one of a gravity direction or an oblique direction at an angle of smaller than 30° with the gravity direction;

forming a cutting induction groove on an outer peripheral side surface of the honeycomb structure with a separate notching member of a cutting device comprising the separate notching member and a cutting small-gage wire while continuing to extrude the honeycomb structure;

inserting the cutting small-gage wire of the cutting device into the cutting induction groove; and cutting the honeycomb structure with the cutting small-gage wire, wherein forming the cutting induction groove by the separate notching member of the cutting device and inserting the cutting small-gage wire of the cutting device into the induction groove are carried out substantially simultaneously, and the separate notching member is provided at a position to notch the honeycomb structure on a plane including the stretched cutting small-gage wire.

14. A method for producing a honeycomb structure according to claim 13, wherein the cutting of the honeycomb structure is carried out while moving the cutting device at substantially a same speed as an extrusion speed of the honeycomb structure in the lengthwise direction and in substantially a same direction as the lengthwise direction.

15. A method for producing a honeycomb structure according to claim 13, further comprising supporting a cell opening end face of the honeycomb structure on a cradle, wherein the cutting of the honeycomb structure is carried out in a state of the honeycomb structure being supported on the cradle.

16. A method for producing a honeycomb structure according to claim 14, further comprising supporting a cell opening end face of the honeycomb structure on a cradle, wherein the cutting of the honeycomb structure is carried out in a state of the honeycomb structure being supported on the cradle.

17. A method for producing a honeycomb structure according to claim 13, further comprising stretching the cutting small-gage wire in the cutting device, wherein the cutting of the honeycomb structure is carried out while stretching the cutting small-gage wire.

18. A method for producing a honeycomb structure according to claim 14, further comprising stretching the cutting small-gage wire in the cutting device, wherein the cutting of the honeycomb structure is carried out while stretching the cutting small-gage wire.

19. A method for producing a honeycomb structure according to claim 15, further comprising stretching the cutting small-gage wire in the cutting device, wherein the cutting of the honeycomb structure is carried out while stretching the cutting small-gage wire.

20. A method for producing a honeycomb structure according to claim 16, further comprising stretching the cutting small-gage wire in the cutting device, wherein the cutting of the honeycomb structure is carried out while stretching the cutting small-gage wire.

* * * * *